US009175362B2

(12) United States Patent
Murakami et al.

(10) Patent No.: US 9,175,362 B2
(45) Date of Patent: Nov. 3, 2015

(54) METHOD OF MANUFACTURING GRAIN-ORIENTED ELECTRICAL STEEL SHEET

(75) Inventors: Kenichi Murakami, Tokyo (JP); Yoshiyuki Ushigami, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 172 days.

(21) Appl. No.: 13/579,692

(22) PCT Filed: Feb. 18, 2011

(86) PCT No.: PCT/JP2011/053488

§ 371 (c)(1), (2), (4) Date: Aug. 17, 2012

(87) PCT Pub. No.: WO2011/102455

PCT Pub. Date: Aug. 25, 2011

(65) Prior Publication Data

US 2012/0312424 A1 Dec. 13, 2012

(30) Foreign Application Priority Data

Feb. 18, 2010 (JP) ..... 2010-033906

(51) Int. Cl.

| | |
|---|---|
| ***C21D 8/12*** | (2006.01) |
| ***C21D 3/04*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/34*** | (2006.01) |
| ***C23C 8/02*** | (2006.01) |
| ***C23C 8/80*** | (2006.01) |
| ***H01F 1/16*** | (2006.01) |
| ***C22C 38/02*** | (2006.01) |
| ***C22C 33/04*** | (2006.01) |
| ***C22C 38/14*** | (2006.01) |
| ***C22C 38/16*** | (2006.01) |
| ***C23C 8/00*** | (2006.01) |
| ***C21D 8/00*** | (2006.01) |

(52) U.S. Cl.

CPC .. *C21D 8/12* (2013.01); *C21D 3/04* (2013.01); *C21D 9/46* (2013.01); *C22C 33/04* (2013.01); *C22C 38/001* (2013.01); *C22C 38/008* (2013.01); *C22C 38/02* (2013.01); *C22C 38/04* (2013.01); *C22C 38/06* (2013.01); *C22C 38/14* (2013.01); *C22C 38/16* (2013.01); *C22C 38/34* (2013.01); *C23C 8/02* (2013.01); *C23C 8/80* (2013.01); *H01F 1/16* (2013.01)

(58) Field of Classification Search

CPC ..... C21D 3/04; C21D 8/12; C21D 9/46; C22C 33/04; C22C 38/001; C22C 38/008; C22C 38/02; C22C 38/04; C22C 38/06; C22C 38/14; C22C 38/16; C22C 38/34; H01F 1/16; C23C 8/02; C23C 8/80

USPC ..... 148/208, 316–318, 332, 650, 651; 420/89, 117, 118, 126, 128

See application file for complete search history.

(56) References Cited

U.S. PATENT DOCUMENTS

| | | | | |
|---|---|---|---|---|
| 4,938,807 | A | 7/1990 | Takahashi et al. | |
| 6,361,620 | B1 | 3/2002 | Cicale et al. | |
| 6,451,128 | B1 * | 9/2002 | Lee et al. | 148/111 |

FOREIGN PATENT DOCUMENTS

| | | |
|---|---|---|
| CN | 1231001 | 10/1999 |
| JP | 1-301820 | 12/1989 |
| JP | 2-200733 | 8/1990 |
| JP | 2-294428 | 12/1990 |
| JP | 3-122227 | 5/1991 |
| JP | 6-228646 | 8/1994 |
| JP | 7-252531 | 10/1995 |
| JP | 8-279408 | 10/1996 |
| JP | 2001-040416 | 2/2001 |
| JP | 2001-515540 | 9/2001 |
| JP | 2007-254829 | 10/2007 |
| JP | 2009-209428 | 9/2009 |
| JP | 2009-256713 | 11/2009 |
| KR | 10-0817168 | 3/2008 |

(Continued)

OTHER PUBLICATIONS

International Search Report dated Apr. 19, 2011, issued in corresponding PCT Application No. PCT/JP2011/053488.

(Continued)

*Primary Examiner* — Roy King
*Assistant Examiner* — Caitlin Kiechle
(74) *Attorney, Agent, or Firm* — Kenyon & Kenyon LLP

(57) ABSTRACT

Hot rolling is performed on a steel with a predetermined composition containing Ti: 0.0020 mass % to 0.010 mass % and/or Cu: 0.010 mass % to 0.50 mass % to obtain a hot-rolled steel sheet. Annealing is performed on the hot-rolled steel sheet to obtain an annealed steel sheet. Cold rolling is performed on the annealed steel sheet to obtain a cold-rolled steel sheet. Decarburization annealing and nitridation annealing are performed on the cold-rolled steel sheet to obtain a decarburized nitrided steel sheet. Then, finish annealing is performed on the decarburized nitrided steel sheet. When obtaining the decarburized nitrided steel sheet, heating on the cold-rolled steel sheet is started in a decarburizing and nitriding atmosphere, then first annealing is performed at a first temperature within a predetermined range, and then second annealing is performed at a second temperature within a predetermined range.

19 Claims, 2 Drawing Sheets

(56) References Cited

FOREIGN PATENT DOCUMENTS

| | | |
|---|---|---|
| WO | 2008/078947 | 7/2008 |
| WO | WO 2008078915 A1 * | 7/2008 |
| WO | 2009/091127 | 7/2009 |

OTHER PUBLICATIONS

International Preliminary Report on Patentability dated Oct. 12, 2012 issued in corresponding PCT Application No. PCT/JP2011/053488.
Extended Search Report of Apr. 7, 2014 issued in corresponding European Application No. 11744741.7 [with English Summary].

* cited by examiner

METHOD OF MANUFACTURING GRAIN-ORIENTED ELECTRICAL STEEL SHEET

This application is a national stage application of International Application No. PCT/JP2011/053488, filed Feb. 18, 2011, which claims priority to Japanese Application No. 2010-033906, filed Feb. 18, 2010, the content of which is incorporated by reference herein in its entirety.

TECHNICAL FIELD

The present invention relates to a method of manufacturing a grain-oriented electrical steel sheet in which the variation in magnetic property is suppressed.

BACKGROUND ART

A grain-oriented electrical steel sheet is a steel sheet which contains Si and in which crystal grains are highly integrated in a {110}<001> orientation, and is used as a material of a wound core of a stationary induction apparatus such as a transformer. The control of the orientation of the crystal grains is conducted with catastrophic grain growth phenomenon called secondary recrystallization.

As a method of controlling the secondary recrystallization, the following two methods can be cited. In one method, heating is performed on a slab at a temperature of 1280° C. or higher to almost completely solid-solve fine precipitates called inhibitors, and thereafter hot rolling, cold rolling, annealing and so on are performed to cause the fine precipitates to precipitate during the hot rolling and the annealing. In the other method, heating is performed on a slab at a temperature of lower than 1280° C., and thereafter hot rolling, cold rolling, decarburization annealing, nitriding, finish annealing and so on are performed to cause AlN (Al, Si)N and the like to precipitate as inhibitors during the nitriding. The former method is sometimes called a high-temperature slab heating method, and the latter method is sometimes called a low-temperature slab heating method.

In the low-temperature slab heating method, nitridation annealing is normally performed after decarburization annealing also serving as primary recrystallization annealing is performed, and the decarburization annealing and the nitridation annealing are tried to be simultaneously performed in recent years. If it becomes possible to simultaneously perform the decarburization annealing and the nitridation annealing, it becomes possible to perform them in one furnace and use existing annealing facilities, and to reduce the total treatment time required for annealing and suppress the energy consumption.

However, simultaneously performing the decarburization annealing and the nitridation annealing causes a remarkable variation in magnetic property (magnetic property deviation) depending on site, after the finish annealing performed with the steel being coiled.

CITATION LIST

Patent Literature

Patent Literature 1: Japanese Laid-open Patent Publication No. 3-122227

Patent Literature 2: Korean Registered Patent Publication No. 817168

Patent Literature 3: Japanese Laid-open Patent Publication No. 2009-209428

Patent Literature 4: Japanese Laid-open Patent Publication No. 7-252351

Patent Literature 5: Japanese National Publication of International Patent Application No. 2001-515540

Patent Literature 6: Japanese Laid-open Patent Publication No. 2007-254829

SUMMARY OF THE INVENTION

Technical Problem

An object of the present invention is to provide a method of manufacturing a grain-oriented electrical steel sheet, capable of suppressing the variation in magnetic property.

Solution to Problem

It turned out that the above-described variation in magnetic properties after the finish annealing is remarkable when using a slab containing a low C content, in particular, when the C content is 0.06 mass % or less. The reason when the slab containing a low C content is that a reduction in time period used for the decarburization annealing in a manufacturing process of the grain-oriented electrical steel sheet is required from the viewpoint of reducing $CO_2$ emissions in recent years. Although the cause of the variation in magnetic property after the finish annealing is not exactly known, the variation is considered to occur because the crystal grains sometimes do not uniformly grow during the finish annealing even if the crystal grains seem to be uniform before the finish annealing. Further, the conceivable reason why the crystal grains do not uniformly grow is that when the decarburization annealing and the nitridation annealing are simultaneously performed, the primary recrystallization and the nitridation proceed during the decarburization annealing, thereby causing a difference in size of a precipitate in the thickness direction of the steel sheet. More specifically, the primary recrystallized grain is less likely to grow on the surface layer portion of the steel sheet due to the formation of the precipitate with the nitridation, whereas the primary recrystallized grain is more likely to grow at the central portion because the precipitate is not formed before a certain amount of nitrogen diffuses. Accordingly, it is conceivable that there occurs variation in the grain diameter of the primary recrystallized grain to make the grain diameter (secondary recrystallization grain diameter) obtained through secondary recrystallization non-uniform, resulting in a large variation in magnetic property.

The present inventors thought, based on such knowledge, that it is possible to uniformly cause the secondary recrystallization through forming an effective precipitate in order to make the crystal grain growth uniform during the finish annealing in the low-temperature slab heating method in which the decarburization annealing and the nitridation annealing are simultaneously performed. Then, the present inventors repeatedly carried out an experiment of measuring the magnetic properties of the grain-oriented electrical steel sheets obtained through adding various kinds of elements to slabs. As a result, the present inventors found that addition of Ti and Cu was effective to make the secondary recrystallization uniform.

The present invention has been made based on the above-described knowledge, and a summary thereof is as follows.

(1) A method of manufacturing a grain-oriented electrical steel sheet, including:

performing hot rolling on a steel containing Si: 2.5 mass % to 4.0 mass %, C: 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, and P: 0.01 mass % to 0.08 mass %, further containing at least one kind selected from a group consisting of Ti: 0.0020 mass % to 0.010 mass % and Cu: 0.010 mass % to 0.50 mass %, and a balance composed of Fe and inevitable impurities, to obtain a hot-rolled sheet;

performing annealing on the hot-rolled steel sheet to obtain an annealed steel sheet;

performing cold rolling on the annealed steel sheet to obtain a cold-rolled steel sheet;

performing decarburization annealing and nitridation annealing on the cold-rolled steel sheet to obtain a decarburized nitrided steel sheet; and performing finish annealing on the decarburized nitrided steel sheet, wherein the obtaining the decarburized nitrided steel sheet includes:

starting heating on the cold-rolled steel sheet in a decarburizing and nitriding atmosphere;

then performing first annealing at a first temperature within a range of 700° C. to 950° C.; and then, performing second annealing at a second temperature within a range of 850° C. to 950° C. when the first temperature is lower than 800° C. and within a range of 800° C. to 950° C. when the first temperature is 800° C. or higher.

(2) The method of manufacturing a grain-oriented electrical steel sheet according to (1), wherein the first temperature falls within a range of 700° C. to 850° C., and the second temperature falls within a range of 850° C. to 950° C.

(3) The method of manufacturing a grain-oriented electrical steel sheet according to (1) or (2), wherein the steel further contains at least one kind selected from a group consisting of Cr: 0.010 mass % to 0.20 mass %, Sn: 0.010 mass % to 0.20 mass %, Sb: 0.010 mass % to 0.20 mass %, Ni: 0.010 mass % to 0.20 mass %, Se: 0.005 mass % to 0.02 mass %, Bi: 0.005 mass % to 0.02 mass %, Pb: 0.005 mass % to 0.02 mass %, B: 0.005 mass % to 0.02 mass %, V: 0.005 mass % to 0.02 mass %, Mo: 0.005 mass % to 0.02 mass %, and As: 0.005 mass % to 0.02 mass %.

(4) The method of manufacturing a grain-oriented electrical steel sheet according to any one of (1) to (3), wherein a Ti content in the steel is 0.0020 mass % to 0.0080 mass %, a Cu content in the steel is 0.01 mass % to 0.10 mass %, and a relation of "$20\times[Ti]+[Cu]\leq 0.18$" is established where the Ti content (mass %) in the steel is expressed as [Ti] and the Cu content (mass %) is expressed as [Cu].

(5) The method of manufacturing a grain-oriented electrical steel sheet according to (4), wherein a relation of "$10\times[Ti]+[Cu]\leq 0.07$" is established.

(6) The method of manufacturing a grain-oriented electrical steel sheet according to any one of (1) to (5), wherein the hot rolling on the steel is performed after heating the steel to a temperature of 1250° C. or lower.

(7) The method of manufacturing a grain-oriented electrical steel sheet according to any one of (1) to (6), wherein time periods of the first annealing and the second annealing are 15 seconds or more.

Advantageous Effects of Invention

According to the present invention, appropriate amounts of Ti and/or Cu are contained in the steel, and decarburization annealing and nitridation annealing is performed at appropriate temperatures, thereby making it possible to suppress the variation in magnetic property.

DESCRIPTION OF EMBODIMENTS

As described above, the present inventors repeatedly conducted the experiments of measuring the magnetic properties of grain-oriented electrical steel sheets obtained through adding various kinds of elements to slabs and found out that addition of Ti and Cu is effective to make the secondary recrystallization uniform.

In the experiment, silicon steel with a composition used for manufacturing a grain-oriented electrical steel sheet based on a low-temperature slab heating method was used, for example. Further, Ti and Cu were contained at various ratios into the silicon steel to produce steel ingots with various compositions. Further, the steel ingots were heated at a temperature of 1250° C. or lower and subjected to hot rolling, and then subjected to cold rolling. Furthermore, decarburization annealing and nitridation annealing were simultaneously performed after the cold rolling, and then finish rolling was performed. Then, the magnetic flux densities B8 of the obtained grain-oriented electrical steel sheets were measured and the variations in the magnetic flux densities B8 in coils after the finish annealing were checked. The magnetic flux density B8 is the magnetic flux density occurring in the grain-oriented electrical steel sheet when a magnetic field of 800 A/m at 50 Hz is applied thereto.

As a result of the experiment, it was found out that the variation in the magnetic flux density B8 in the coil after the finish annealing is remarkably reduced when the steel ingot contains 0.0020 mass % to 0.010 mass % of Ti and/or 0.010 mass % to 0.50 mass % of Cu.

Figure 1:
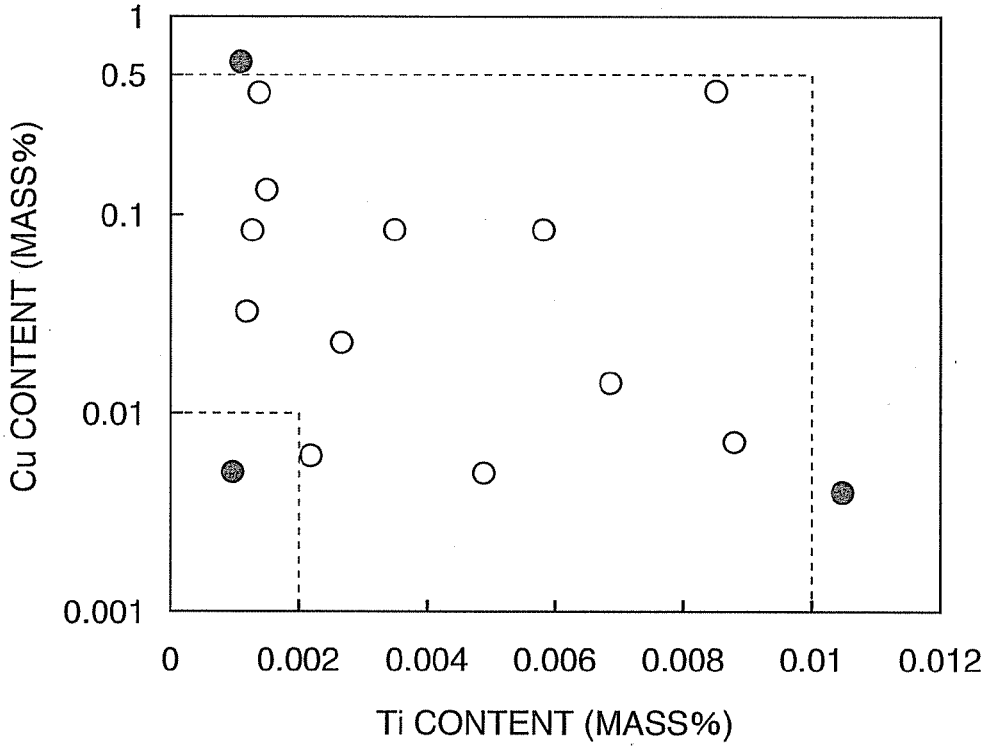
FIG. 1 is a chart representing the relation between a Ti content and a Cu content and the magnetic flux density and the evaluation of its variation.

An example of the results obtained through the above-described experiments is illustrated in FIG. 1. Though details of the experiments will be described later, an open circle mark in FIG. 1 indicates that the average value of the magnetic flux densities B8 of five single-plate samples was 1.90T or more and the difference between the maximum value and the minimum value of the magnetic flux density B8 was 0.030T or less. Further, a filled circle mark in FIG. 1 indicates that at least the average value of the magnetic flux densities B8 of five single-plate samples was less than 1.90T or the difference between the maximum value and the minimum value of the magnetic flux density B8 was more than 0.030T. It is apparent from FIG. 1 that when the steel ingot contains 0.0020 mass % to 0.010 mass % of Ti and/or 0.010 mass % to 0.50 mass % of Cu, the average value of the magnetic flux densities B8 is high and the variation in the magnetic flux density B8 is small.

Figure 2:
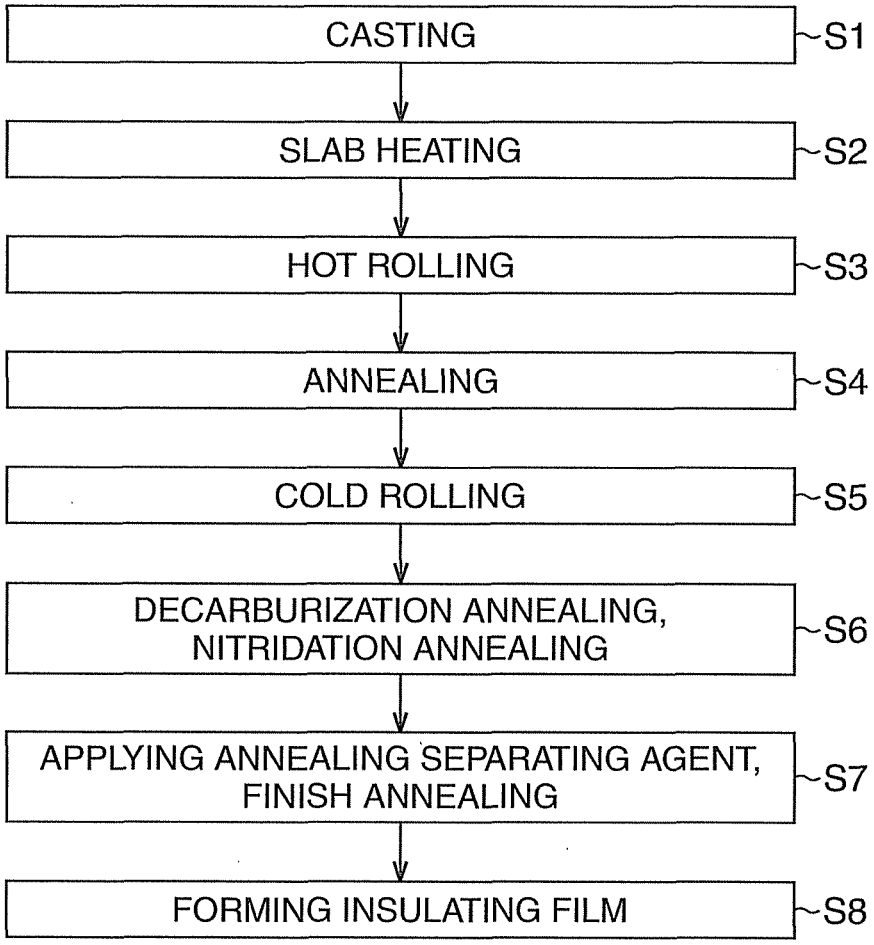
FIG. 2 is a flowchart illustrating a method of manufacturing a grain-oriented electrical steel sheet according to an embodiment of the present invention.

Next, a method of manufacturing a grain-oriented electrical steel sheet according to an embodiment of the present invention will be described. FIG. 2 is a flowchart illustrating the method of manufacturing a grain-oriented electrical steel sheet according to the embodiment of the present invention.

In the present embodiment, first, a slab is produced through casting of molten steel for a grain-oriented electrical steel sheet with a predetermined composition (Step 1). The casting method therefor is not particularly limited. The molten steel contains, for example, Si: 2.5 mass % to 4.0 mass %, C: 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, and P: 0.01 mass % to 0.08 mass %. The molten steel further contains at least one kind selected from a group consisting of Ti: 0.0020 mass % to 0.010 mass % and Cu: 0.010 mass % to 0.50 mass %. In short, the molten steel contains one or both of Ti and Cu in ranges of Ti: 0.010 mass % or less and Cu: 0.50 mass % or less to satisfy at least one of Ti: 0.0020 mass % or more or Cu: 0.010 mass % or more. The balance of the molten steel may be composed of Fe and inevitable impurities. Note that the inevitable impurities may include an element(s) forming an inhibitor in the manufacturing process of the grain-oriented electrical steel sheet and remaining in the grain-oriented electrical steel sheet after purification is performed through high-temperature annealing.

Here, reasons for numerical limitations of the composition of the above-described molten steel will be explained.

Si is an element that is extremely effective to enhance the electrical resistance of the grain-oriented electrical steel sheet to reduce the eddy current loss constituting a part of the core loss. When the Si content is less than 2.5 mass %, the eddy current loss cannot be sufficiently suppressed. On the other hand, when the Si content is more than 4.0 mass %, the processability is lowered. Accordingly, the Si content is set to 2.5 mass % to 4.0 mass %.

C is an element that is effective to control the structure (primary recrystallization structure) obtained through primary recrystallization. When the C content is less than 0.02 mass %, the effect cannot be sufficiently obtained. On the other hand, when the C content is more than 0.10 mass, the time required for decarburization annealing increases, resulting in a larger exhaust amount of $CO_2$. Note that when the decarburization annealing is insufficient, the grain-oriented electrical steel sheet with excellent magnetic properties is less likely to be obtained. Accordingly, the C content is set to 0.02 mass % to 0.10 mass %. Further, since the variation in magnetic property after finish annealing is particularly prominent when the C content is 0.06 mass % or less in the conventional technique as described above, the embodiment is particularly effective in the case where the C content is 0.06 mass % or less.

Mn increases the specific resistance of the grain-oriented electrical steel sheet to reduce the core loss. Mn also functions to prevent occurrence of cracks in the hot rolling. When the Mn content is less than 0.05 mass %, the effects cannot be sufficiently obtained. On the other hand, when the Mn content is more than 0.20 mass %, the magnetic flux density of the grain-oriented electrical steel sheet is lowered. Accordingly, the Mn content is set to 0.05 mass % to 0.20 mass %.

Acid-soluble Al is an important element forming AlN serving as an inhibitor. When the acid-soluble Al content is less than 0.020 mass %, a sufficient amount of AlN cannot be formed, resulting in insufficient inhibitor strength. On the other hand, when the acid-soluble Al content is more than 0.040 mass %, AlN becomes coarse, resulting in a decrease in inhibitor strength. Accordingly, the acid-soluble Al content is set to 0.020 mass % to 0.040 mass %.

N is an important element forming AlN through reacting with the acid-soluble Al. Though a large amount of N does not need to be contained in the grain-oriented electrical steel sheet because nitridation annealing is performed after the cold rolling as will be described later, a great load may be required in steelmaking in order to make the N content less than 0.002 mass %. On the other hand, when the N content is more than 0.012 mass %, a hole called blister is generated in the steel sheet in the cold rolling. Accordingly, the N content is set to 0.002 mass % to 0.012 mass %. The N content is preferably 0.010% mass % or less in order to further reduce the blister.

S is an important element forming a MnS precipitate through reacting with Mn. The MnS precipitate mainly affects the primary recrystallization and functions to suppress the variation depending on site in grain growth in the primary recrystallization due to the hot rolling. When the Mn content is less than 0.001 mass %, the effect cannot be sufficiently obtained. On the other hand, when the Mn content is more than 0.010 mass %, the magnetic property is likely to decrease. Accordingly, the Mn content is set to 0.001 mass % to 0.010 mass %. The Mn content is preferably 0.009 mass % or less in order to further improve the magnetic property.

P increases the specific resistance of the grain-oriented electrical steel sheet to reduce the core loss. When the P content is less than 0.01 mass %, the effect cannot be sufficiently obtained. On the other hand, when the P content is more than 0.08 mass %, the cold rolling may become difficult to perform. Accordingly, the P content is set to 0.01 mass % to 0.08 mass %.

Ti forms a TiN precipitate through reacting with N. Further, Cu forms a CuS precipitate through reacting with S. These precipitates function to make the growth of the crystal grains in the finish annealing uniform irrespective of the site of the coil and suppress the variation in magnetic property of the grain-oriented electrical steel sheet. In particular, the TiN precipitate is considered to suppress the variation in grain growth in a high temperature region in the finish annealing to decrease the deviation of the magnetic property of the grain-oriented electrical steel sheet. Further, the CuS precipitate is considered to suppress the variation in grain growth in a low temperature region in the decarburization annealing and the finish annealing to decrease the deviation of the magnetic property of the grain-oriented electrical steel sheet. When the Ti content is less than 0.0020 mass % and the Cu content is less than 0.010 mass %, the effects cannot be sufficiently obtained. On the other hand, when the Ti content is more than 0.010 mass %, the TiN precipitate is excessively formed and remains even after the finish annealing. Similarly, when the Cu content is more than 0.50 mass %, the CuS precipitate is excessively formed and remains even after the finish annealing. If these precipitates remain in the grain-oriented electrical steel sheet, it is difficult to obtain a high magnetic property. Accordingly, the molten steel contains one or both of Ti and Cu in ranges of Ti: 0.010 mass % or less and Cu: 0.50 mass % or less to satisfy at least one of Ti: 0.0020 mass % or more or Cu: 0.010 mass % or more. In short, the molten steel contains at least one kind selected from a group consisting of Ti: 0.0020 mass % to 0.010 mass % and Cu: 0.010 mass % to 0.50 mass %.

Note that the lower limit of the Ti content is preferably 0.0020 mass %, and the upper limit of the Ti content is preferably 0.0080 mass %. Further, the lower limit of the Cu content is preferably 0.01 mass %, and the upper limit of the Cu content is preferably 0.10 mass %. Further, where the Ti content (mass %) is expressed as [Ti] and the Cu content (mass %) is expressed as [Cu], it is more preferable that the relation of "$20\times[Ti]+[Cu]\leq 50.18$" is established and, preferably, the relation of "$10\times[Ti]+[Cu]\leq 0.07$" is established.

Note that at least one kind of the following various kinds of elements may be contained in the molten steel.

Cr and Sn improve the quality of an oxide layer to be formed in the decarburization annealing and improve the quality of a glass film to be formed of the oxide layer in the finish annealing. In other words, Cr and Sn improve the magnetic property through stabilization of the formation of the oxide layer and the glass film to suppress the variation in the magnetic property. However, when the Cr content is more than 0.20 mass %, the formation of the glass film may be unstable. Further, when the Sn content is more than 0.20 mass %, the surface of the steel sheet may be less likely to be oxidized to result in insufficient formation of the glass film. Accordingly, each of the Cr content and the Sn content is preferably 0.20 mass % or less. Further, in order to sufficiently obtain the above effects, each of the Cr content and the Sn content is preferably 0.01 mass % or more. Note that Sn is a grain boundary segregation element and thus also has an effect to stabilize secondary recrystallization.

Further, the molten steel may contain Sb: 0.010 mass % to 0.20 mass %, Ni: 0.010 mass % to 0.20 mass %, Se: 0.005 mass % to 0.02 mass %, Bi: 0.005 mass % to 0.02 mass %, Pb: 0.005 mass % to 0.02 mass %, B: 0.005 mass % to 0.02 mass %, V: 0.005 mass % to 0.02 mass %, Mo: 0.005 mass % to 0.02 mass %, and/or As: 0.005 mass % to 0.02 mass %. These elements may be inhibitor strengthening elements.

In the embodiment, after the slab is produced from the molten steel with the composition, the slab is heated (Step S2). The temperature of the heating is preferably set to 1250° C. or lower from the viewpoint of energy saving.

Next, hot rolling is performed on the slab to obtain a hot-rolled steel sheet (Step S3). The thickness of the hot-rolled steel sheet is not particularly limited, and may be set to 1.8 mm to 3.5 mm.

Thereafter, annealing is performed on the hot-rolled steel sheet to obtain an annealed steel sheet (Step S4). The condition of the annealing is not particularly limited, and the annealing may be performed, for example, at a temperature of 750° C. to 1200° C. for 30 seconds to 10 minutes. The annealing improves the magnetic property.

Subsequently, cold rolling is performed on the annealed steel sheet to obtain a cold-rolled steel sheet (Step S5). The cold rolling may be performed only once or a plurality of times while an intermediate annealing is performed therebetween. The intermediate annealing is preferably performed at a temperature of 750° C. to 1200° C. for 30 seconds to 10 minutes.

Note that if the cold rolling is performed without performing the above-described intermediate annealing, it may be difficult to obtain uniform properties. On the other hand, if the cold rolling is performed a plurality of times while the intermediate annealing is performed therebetween, the uniform properties are easily obtained but the magnetic flux density may decrease. Accordingly, it is preferable to determine the number of times of the cold rolling and the presence or absence of the intermediate annealing according to the property required for and the cost of the finally obtained grain-oriented electrical steel sheet.

Further, in any case, it is preferable to set the rolling reduction at the final cold rolling to 80% to 95%.

The decarburization annealing and nitridation annealing (decarburization and nitridation annealing) is performed on the cold-rolled steel sheet in a decarburizing and nitriding atmosphere after the cold rolling to obtain a decarburized nitrided steel sheet (Step S6). The decarburization annealing removes carbon in the steel sheet and causes primary recrystallization. Further, the nitridation annealing increases the nitrogen content in the steel sheet. An example of the decarburizing and nitriding atmosphere is a moist atmosphere containing hydrogen, nitrogen, water vapor and gas (ammonia or the like) having a nitriding capability.

In the decarburization and nitridation annealing, at least the heating of the cold-rolled steel sheet is started in the decarburizing and nitriding atmosphere, then a first annealing is performed at a temperature T1 within a range of 700° C. to 950° C., and then a second annealing is performed at a temperature T2. More specifically, the atmosphere containing the gas having the nitriding capability is prepared prior to the generation of decarburization, and the decarburization and the nitridation are simultaneously performed. The temperature T2 here is a temperature within a range of 850° C. to 950° C. when the temperature T1 is lower than 800° C., and is a temperature within a range of 800° C. to 950° C. when the temperature T1 is 800° C. or higher. Further, it is preferable to keep the cold-rolled steel sheet at the temperature T1 and at the temperature T2 for 15 seconds or more each. The decarburization, primary recrystallization, and nitridation may occur in both of the annealing at the temperature T1 and the annealing at the temperature T2, and the annealing at the temperature T1 mainly contributes to nitridation and the annealing at the temperature T2 mainly contributes to appearance of the primary recrystallization.

When the temperature T1 is lower than 700° C., the crystal grain obtained through the primary recrystallization (primary recrystallized grain) is small so that the subsequent secondary recrystallization does not sufficiently appear. On the other hand, when the temperature T1 is higher than 950° C., the primary recrystallized grain is large so that the subsequent secondary recrystallization does not sufficiently appear. Further, when the temperature T2 is lower than 850° C. when the temperature T1 is lower than 800° C., the crystal grain (primary recrystallized grain) obtained through the primary recrystallization is small so that the subsequent secondary recrystallization does not sufficiently appear. Similarly, when the temperature T2 is lower than 800° C., even when the temperature T1 is higher than 800° C., the crystal grain (primary recrystallized grain) obtained through the primary recrystallization is small so that the subsequent secondary recrystallization does not sufficiently appear. On the other hand, when the temperature T2 is higher than 950° C., the primary recrystallized grain is large so that the subsequent secondary recrystallization does not sufficiently appear. Further, when the temperature T1 is lower than 700° C. or when the temperature T1 and the temperature T2 are higher than 950° C., nitrogen is less likely to diffuse inside the steel sheet, so that the subsequent secondary recrystallization does not sufficiently appear.

Further, when each holding time at the temperatures T1 and T2 is shorter than 15 seconds, the nitridation may be insufficient or the primary recrystallized grain may be small. In particular, when the holding time at the temperature T1 is shorter than 15 seconds, the nitridation is likely to insufficient, and when the holding time at the temperature T2 is shorter than 15 seconds, the primary recrystallized grain with a sufficient size is less likely to be obtained.

Note that the temperature T2 may be made equal to the temperature T1. In other words, if the temperature T1 is 800° C. or higher, the annealing at the temperature T1 and the annealing at the temperature T2 may be continuously performed. Further, when the temperature T1 and the temperature T2 are made different, it is preferable to set the temperature T1 to a temperature suitable for nitridation and set the temperature T2 to a temperature suitable for appearance of the primary recrystallization. Setting the temperature T1 and the second temperature T2 as described above makes it possible to further increase the magnetic flux density and further suppress the variation in magnetic flux density. For example, it is preferable to set the temperature T1 to a temperature in a range of 700° C. to 850° C., and to set the temperature T2 to a temperature in a range of 850° C. to 950° C.

When the temperature T1 falls within the range of 700° C. to 850° C., it is possible to particularly effectively diffuse the nitrogen entering the surface of the steel sheet to the central portion of the steel sheet. Accordingly, the secondary recrystallization sufficiently appears and an excellent magnetic property is obtained. Further, when the temperature T2 falls within the range of 850° C. to 950° C., it is possible to adjust the primary recrystallized grain to a particularly preferable size. Accordingly, the secondary recrystallization sufficiently appears and an excellent magnetic property is obtained.

After the decarburization and nitridation annealing, an annealing separating agent containing MgO as a main component is applied, in a water slurry, to the surface of the decarburized nitrided steel sheet, and the decarburized nitrided steel sheet is coiled. Then, batch-type finish annealing is performed on the coiled decarburized nitrided steel sheet to obtain a coiled finish-annealed steel sheet (Step S7). The finish annealing causes secondary recrystallization.

Thereafter, the coiled finish-annealed steel sheet is uncoiled, and the annealing separating agent is removed. Subsequently, a coating solution containing aluminum phosphate and colloidal silica as main components is applied to the surface of the finish-annealed steel sheet, and baking is performed thereon to form an insulating film (Step S8).

In the above manner, the grain-oriented electrical steel sheet can be manufactured.

Note that the steel being an object for the hot rolling is not limited to the slab obtained through casting of the molten steel, but a so-called thin slab may be used. Further, when using the thin slab, it is not always necessary to perform the slab heating at 1250° C. or lower.

EXAMPLE

Next, the experiments carried out by the present inventers will be described. The conditions and so on in the experiments are examples employed to verify the practicability and the effects of the present invention, and the present invention is not limited to those examples.

(First Experiment)

First, 15 kinds of steel ingots each containing Si: 3.1 mass %, C: 0.06 mass %, Mn: 0.10 mass %, acid-soluble Al: 0.029 mass %, N: 0.008 mass %, S: 0.0060 mass %, and P: 0.030 mass %, further containing Ti and Cu in amounts listed in Table 1, and the balance composed of Fe and inevitable impurities were produced using a vacuum melting furnace. Then, annealing was performed on the steel ingots at 1150° C. for one hour, and then hot rolling was performed thereon to obtain hot-rolled steel sheets with a thickness of 2.3 mm.

Subsequently, annealing was performed on the hot-rolled steel sheets at 1100° C. for 120 seconds to obtain annealed steel sheets. Then, acid pickling was performed on the annealed steel sheets, and then cold rolling was performed on the annealed steel sheets to obtain cold-rolled steel sheets with a thickness of 0.23 mm. Subsequently, decarburization annealing and nitridation annealing (decarburization and nitridation annealing) was performed on the cold-rolled steel sheets in an atmosphere containing water vapor, hydrogen, nitrogen and ammonia to obtain decarburized nitrided steel sheets. In the decarburization and nitridation annealing, annealing was performed at a temperature T1 of 800° C. to 840° C. for 40 seconds, and then annealing was performed at 870° C. for 70 seconds.

Thereafter, an annealing separating agent containing MgO as a main component was applied, in a water slurry, to the surfaces of the decarburized nitrided steel sheets. Then, finish annealing was performed on them at 1200° C. for 20 hours to obtain finish-annealed steel sheets. Subsequently, the finish-annealed steel sheets were washed with water, and then cutout into a single-plate magnetic measurement size with a width of 60 mm and a length of 300 mm. Subsequently, a coating solution containing aluminum phosphate and colloidal silica as main components was applied to the surfaces of the finish-annealed steel sheets, and baking was performed thereon to form an insulating film. In this manner, samples of the grain-oriented electrical steel sheets were obtained.

Then, the magnetic flux density B8 of each of the grain-oriented electrical steel sheets was measured. The magnetic flux density B8 is the magnetic flux density occurring in the grain-oriented electrical steel sheet when a magnetic field of 800 A/m at 50 Hz is applied thereto as described above. Note that the magnetic flux densities B8 of five single-plate samples for measurement were measured for each of the samples. Then, for each sample, the average value "average B8," the maximum value "B8max," and the minimum value "B8min" were obtained. The difference "ΔB8" between the maximum value "B8max" and the minimum value "B8min" was also obtained. The difference "ΔB8" is an index indicating the fluctuation range of the magnetic property. These results are listed in Table 1 together with the Ti contents and the Cu contents. Further, the evaluation results based on the average value "average B8" and the difference "ΔB8" are indicated in FIG. 1. As described above, an open circle mark in FIG. 1 indicates that the average value "average B8" was 1.90T or more and the difference "ΔB8" was 0.030T or less. Further, a filled circle mark in FIG. 1 indicates that the average value "average B8" was less than 1.90T or the difference "ΔB8" was more than 0.030T.

TABLE 1

| SAMPLE No. | Ti CONTENT (MASS %) | Cu CONTENT (MASS %) | 20 × [Ti] + [Cu] | 10 × [Ti] + [Cu] | AVERAGE B8 (T) | B8max (T) | B8min (T) | ΔB8 (T) | NOTE |
|---|---|---|---|---|---|---|---|---|---|
| 1 | 0.0010 | 0.005 | 0.025 | 0.015 | 1.909 | 1.926 | 1.872 | 0.054 | COMPARATIVE EXAMPLE |
| 2 | 0.0022 | 0.006 | 0.050 | 0.028 | 1.918 | 1.925 | 1.891 | 0.034 | EMBODIMENT |
| 3 | 0.0049 | 0.005 | 0.103 | 0.054 | 1.916 | 1.924 | 1.892 | 0.032 | EMBODIMENT |
| 4 | 0.0088 | 0.007 | 0.183 | 0.095 | 1.905 | 1.922 | 1.891 | 0.031 | EMBODIMENT |
| 5 | 0.0105 | 0.004 | 0.214 | 0.109 | 1.882 | 1.892 | 1.862 | 0.030 | COMPARATIVE EXAMPLE |
| 6 | 0.0012 | 0.032 | 0.056 | 0.044 | 1.919 | 1.929 | 1.893 | 0.036 | EMBODIMENT |
| 7 | 0.0013 | 0.080 | 0.106 | 0.093 | 1.918 | 1.927 | 1.892 | 0.035 | EMBODIMENT |
| 8 | 0.0015 | 0.131 | 0.161 | 0.146 | 1.916 | 1.924 | 1.891 | 0.033 | EMBODIMENT |
| 9 | 0.0014 | 0.412 | 0.440 | 0.426 | 1.903 | 1.911 | 1.880 | 0.031 | EMBODIMENT |
| 10 | 0.0011 | 0.582 | 0.604 | 0.593 | 1.881 | 1.889 | 1.859 | 0.030 | COMPARATIVE EXAMPLE |
| 11 | 0.0035 | 0.081 | 0.151 | 0.116 | 1.915 | 1.923 | 1.896 | 0.027 | EMBODIMENT |
| 12 | 0.0058 | 0.083 | 0.199 | 0.141 | 1.904 | 1.911 | 1.885 | 0.026 | EMBODIMENT |

TABLE 1-continued

| SAMPLE No. | Ti CONTENT (MASS %) | Cu CONTENT (MASS %) | 20 × [Ti] + [Cu] | 10 × [Ti] + [Cu] | AVERAGE B8 (T) | B8max (T) | B8min (T) | ΔB8 (T) | NOTE |
|---|---|---|---|---|---|---|---|---|---|
| 13 | 0.0069 | 0.014 | 0.152 | 0.083 | 1.912 | 1.920 | 1.893 | 0.027 | EMBODIMENT |
| 14 | 0.0085 | 0.420 | 0.590 | 0.505 | 1.901 | 1.909 | 1.884 | 0.025 | EMBODIMENT |
| 15 | 0.0027 | 0.022 | 0.076 | 0.049 | 1.920 | 1.930 | 1.902 | 0.028 | EMBODIMENT |

As presented in Table 1 and FIG. 1, in the samples No. 2 to No. 4, No. 6 to No. 9, and No. 11 to No. 15, in each of which the Ti content and the Cu content were within the range of the present invention, the average value "average B8" was large to be 1.90T or more and the difference "ΔB8" was small to be 0.030T or less. In short, high magnetic property was obtained and the variation in magnetic property was small.

In particular, the balance between the average value "average B8" and the difference "ΔB8" was excellent in the samples No. 11, No. 13, and No. 15, in which the relation of "20×[Ti]+[Cu]≤0.18" was established where the Ti content (mass %) was expressed as [Ti] and the Cu content (mass %) was expressed as [Cu]. Among them, the balance between the average value "average B8" and the difference "ΔB8" was extremely excellent in the sample No. 15, in which the relation of "10×[Ti]+[Cu]≤0.07" was established.

On the other hand, in the sample No. 1, in which the Ti content was less than 0.0020 mass % and the Cu content was less than 0.010 mass %, the difference "ΔB8" was large to be more than 0.030T. In short, the variation in the magnetic property was large. Further, in the sample No. 5, in which the Ti content was more than 0.010 mass % and the sample No. 10, in which the Cu content was more than 0.50 mass %, a large amount of precipitate was contained to affect the finish annealing, with the result that the average value "average B8" was small to be less than 1.90T. In short, a sufficiently high magnetic property could not be obtained.

(Second Experiment)

First, 3 kinds of steel ingots each containing Si: 3.1 mass %, C: 0.04 mass %, Mn: 0.10 mass %, acid-soluble Al: 0.030 mass %, N: 0.003 mass %, S: 0.0055 mass %, and P: 0.028 mass %, further containing Ti and Cu in amounts listed in Table 2, and the balance composed of Fe and inevitable impurities were produced using a vacuum melting furnace. Then, annealing was performed on the steel ingots at 1150° C. for one hour, and then hot rolling was performed thereon to obtain hot-rolled steel sheets with a thickness of 2.3 mm.

Subsequently, annealing was performed on the hot-rolled steel sheets at 1090° C. for 120 seconds to obtain annealed steel sheets. Then, acid pickling was performed on the annealed steel sheets, and then cold rolling was performed on the annealed steel sheets to obtain cold-rolled steel sheets with a thickness of 0.23 mm. Subsequently, steel sheets for annealing were cutout from the cold-rolled steel sheets, and decarburization annealing and nitridation annealing (decarburization and nitridation annealing) was performed on the steel sheets in an atmosphere containing water vapor, hydrogen, nitrogen and ammonia to obtain decarburized nitrided steel sheets. In the decarburization and nitridation annealing, annealing was performed at 800° C. for 50 seconds, and then annealing was performed at temperatures T2 listed in Table 2 for 80 seconds.

Thereafter, an annealing separating agent containing MgO as a main component was applied, in a water slurry, to the surfaces of the decarburized nitrided steel sheets. Then, finish annealing was performed on them at 1200° C. for 20 hours to obtain finish-annealed steel sheets. Subsequently, treatments from the water washing to the formation of the insulating film were performed similarly to the first experiment to obtain samples of the grain-oriented electrical steel sheets.

Then, for each of the samples, the average value "average B8," the maximum value "B8max," the minimum value "B8min," and the difference "ΔB8" were obtained similarly to the first experiment. These results are listed in Table 2 together with the T1 contents, the Cu contents, and the temperatures T2.

TABLE 2

| SAMPLE No. | Ti CONTENT (MASS %) | Cu CONTENT (MASS %) | 20 × [Ti] + [Cu] | 10 × [Ti] + [Cu] | TEMPERATURE T2 (° C.) | AVERAGE B8 (T) | B8max (T) | B8min (T) | ΔB8 (T) | NOTE |
|---|---|---|---|---|---|---|---|---|---|---|
| 21 | 0.0013 | 0.005 | 0.031 | 0.018 | 780 | 1.842 | 1.861 | 1.829 | 0.031 | COMPARATIVE EXAMPLE |
| 22 | 0.0013 | 0.005 | 0.031 | 0.018 | 820 | 1.903 | 1.916 | 1.879 | 0.037 | COMPARATIVE EXAMPLE |
| 23 | 0.0013 | 0.005 | 0.031 | 0.018 | 870 | 1.910 | 1.928 | 1.884 | 0.044 | COMPARATIVE EXAMPLE |
| 24 | 0.0013 | 0.005 | 0.031 | 0.018 | 920 | 1.902 | 1.934 | 1.863 | 0.071 | COMPARATIVE EXAMPLE |
| 25 | 0.0013 | 0.005 | 0.031 | 0.018 | 960 | 1.723 | 1.872 | 1.621 | 0.251 | COMPARATIVE EXAMPLE |
| 26 | 0.0025 | 0.028 | 0.078 | 0.053 | 780 | 1.841 | 1.859 | 1.833 | 0.026 | COMPARATIVE EXAMPLE |
| 27 | 0.0025 | 0.028 | 0.078 | 0.053 | 820 | 1.910 | 1.918 | 1.896 | 0.022 | EMBODIMENT |
| 28 | 0.0025 | 0.028 | 0.078 | 0.053 | 870 | 1.922 | 1.931 | 1.906 | 0.025 | EMBODIMENT |
| 29 | 0.0025 | 0.028 | 0.078 | 0.053 | 920 | 1.924 | 1.936 | 1.908 | 0.028 | EMBODIMENT |
| 30 | 0.0025 | 0.028 | 0.078 | 0.053 | 960 | 1.822 | 1.871 | 1.772 | 0.099 | COMPARATIVE EXAMPLE |
| 31 | 0.0072 | 0.142 | 0.286 | 0.214 | 780 | 1.846 | 1.862 | 1.834 | 0.028 | COMPARATIVE EXAMPLE |

TABLE 2-continued

| SAMPLE No. | Ti CONTENT (MASS %) | Cu CONTENT (MASS %) | 20 × [Ti] + [Cu] | 10 × [Ti] + [Cu] | TEMPERATURE T2 (° C.) | AVERAGE B8 (T) | B8max (T) | B8min (T) | ΔB8 (T) | NOTE |
|---|---|---|---|---|---|---|---|---|---|---|
| 32 | 0.0072 | 0.142 | 0.286 | 0.214 | 820 | 1.912 | 1.920 | 1.898 | 0.022 | EMBODIMENT |
| 33 | 0.0072 | 0.142 | 0.286 | 0.214 | 870 | 1.924 | 1.932 | 1.906 | 0.026 | EMBODIMENT |
| 34 | 0.0072 | 0.142 | 0.286 | 0.214 | 920 | 1.925 | 1.934 | 1.908 | 0.026 | EMBODIMENT |
| 35 | 0.0072 | 0.142 | 0.286 | 0.214 | 960 | 1.826 | 1.878 | 1.781 | 0.097 | COMPARATIVE EXAMPLE |

As presented in Table 2, in the samples No. 27 to No. 29 and No. 32 to No. 34, in each of which the Ti content, the Cu content, and the temperature T2 were within the range of the present invention, the average value "average B8" was large to be 1.90T or more and the difference "ΔB8" was small to be 0.030T or less. In short, a high magnetic property was obtained and the variation in the magnetic property was small.

On the other hand, in the samples No. 21 to No. 25, in each of which the Ti content was less than 0.0020 mass % and the Cu content was less than 0.010 mass %, the difference "ΔB8" was large to be more than 0.030T. In short, the variation in the magnetic property was large.

Further, in the samples No. 26 and No. 31, in each of which the temperature T2 was lower than 800° C., the average value "average B8" was small to be less than 1.90T. In the samples No. 30 and No. 35 in each of which the temperature T2 was higher than 950° C., the difference "ΔB8" was large to be more than 0.030T and the average value "average B8" was small to be less than 1.90T.

annealing was performed at temperatures T1 within a range of 680° C. to 860° C. listed in Table 3 for 20 seconds, and then annealing was performed at temperatures T2 within a range of 830° C. to 960° C. listed in Table 3 for 90 seconds.

Thereafter, an annealing separating agent containing MgO as a main component was applied, in a water slurry, to the surfaces of the decarburized nitrided steel sheets. Then, finish annealing was performed on them at 1200° C. for 20 hours to obtain finish-annealed steel sheets. Subsequently, treatments from the water washing to the formation of the insulating film were performed similarly to the first experiment to obtain samples of the grain-oriented electrical steel sheets.

Then, for each of the samples, the average value "average B8," the maximum value "B8max," the minimum value "B8min," and the difference "ΔB8" were obtained similarly to the first experiment. These results are listed in Table 3 together with the temperatures T1 and the temperatures T2.

TABLE 3

| SAMPLE No. | TEMPERATURE T1 (° C.) | TEMPERATURE T2 (° C.) | AVERAGE B8 (T) | B8max (T) | B8min (T) | ΔB8 (T) | NOTE |
|---|---|---|---|---|---|---|---|
| 41 | 680 | 880 | 1.894 | 1.905 | 1.874 | 0.031 | COMPARATIVE EXAMPLE |
| 42 | 730 | 880 | 1.920 | 1.929 | 1.907 | 0.022 | EMBODIMENT |
| 43 | 780 | 880 | 1.921 | 1.931 | 1.908 | 0.023 | EMBODIMENT |
| 44 | 830 | 880 | 1.919 | 1.929 | 1.904 | 0.025 | EMBODIMENT |
| 45 | 880 | 880 | 1.909 | 1.921 | 1.893 | 0.028 | EMBODIMENT |
| 46 | 780 | 790 | 1.870 | 1.898 | 1.832 | 0.066 | COMPARATIVE EXAMPLE |
| 47 | 780 | 830 | 1.895 | 1.908 | 1.881 | 0.027 | COMPARATIVE EXAMPLE |
| 48 | 780 | 920 | 1.925 | 1.933 | 1.908 | 0.025 | EMBODIMENT |
| 49 | 780 | 960 | 1.824 | 1.873 | 1.776 | 0.097 | COMPARATIVE EXAMPLE |

(Third Experiment)

First, 9 kinds of steel ingots each containing Si: 3.1 mass %, C: 0.04 mass %, Mn: 0.10 mass %, acid-soluble Al: 0.030 mass %, N: 0.003 mass %, S: 0.0055 mass %, P: 0.028 mass %, Ti: 0.025 mass %, and Cu: 0.028 mass %, and the balance composed of Fe and inevitable impurities were produced using a vacuum melting furnace. Then, annealing was performed on the steel ingots at 1150° C. for one hour, and then hot rolling was performed thereon to obtain hot-rolled steel sheets with a thickness of 2.3 mm.

Subsequently, annealing was performed on the hot-rolled steel sheets at 1070° C. for 120 seconds to obtain annealed steel sheets. Then, acid pickling was performed on the annealed steel sheets, and then cold rolling was performed on the annealed steel sheets to obtain cold-rolled steel sheets with a thickness of 0.23 mm. Subsequently, steel sheets for annealing were cutout from the cold-rolled steel sheets, and decarburization annealing and nitridation annealing (decarburization and nitridation annealing) was performed on the steel sheets in an atmosphere containing water vapor, hydrogen, nitrogen and ammonia to obtain decarburized nitrided steel sheets. In the decarburization and nitridation annealing, As presented in Table 3, in the samples No. 42 to No. 45 and No. 48, in each of which the temperature T1 and the temperature T2 were within the range of the present invention, the average value "average B8" was large to be 1.90T or more and the difference "ΔB8" was small to be 0.030T or less. In short, a high magnetic property was obtained and the variation in the magnetic property was small.

Further, in the samples No. 42 to No. 44 and No. 48, in each of which the temperature T1 falls within a range of 700° C. to 850° C. and the temperature T2 falls within a range of 850° C. to 950° C., the average value "average B8" was particularly large to be 1.91T or more and the difference "ΔB8" was particularly small to be 0.025T or less.

On the other hand, in the sample No. 41, in which the temperature T1 was lower than 700° C., the difference "ΔB8" was large to be more than 0.030T and the average value "average B8" was small to be less than 1.90T. Also in the sample No. 46, in which the temperature T2 was lower than 800° C., the difference "ΔB8" was large to be more than 0.030T and the average value "average B8" was small to be less than 1.90T. Further, also in the sample No. 49, in which the temperature T2 was higher than 950° C., the difference "ΔB8" was large to be more than 0.030T and the average value "average B8" was small to be less than 1.90T. Furthermore, in the sample No. 47, in which the temperature T1 was lower than 800° C. and the temperature T2 was lower than 850° C., the average value "average B8" was small to be less than 1.90T.

(Fourth Experiment)

First, 10 kinds of steel ingots each containing Si: 3.2 mass %, C: 0.048 mass %, Mn: 0.08 mass %, acid-soluble Al: 0.028 mass %, N: 0.004 mass %, S: 0.0061 mass %, P: 0.033 mass %, Ti: 0.0024 mass %, and Cu: 0.029 mass %, further containing Cr and Sn in amounts listed in Table 4, and the balance composed of Fe and inevitable impurities were produced using a vacuum melting furnace. Then, annealing was performed on the steel ingots at 1100° C. for one hour, and then hot rolling was performed thereon to obtain hot-rolled steel sheets with a thickness of 2.3 mm.

Subsequently, annealing was performed on the hot-rolled steel sheets at 1100° C. for 120 seconds to obtain annealed steel sheets. Then, acid pickling was performed on the annealed steel sheets, and then cold rolling was performed on the annealed steel sheets to obtain cold-rolled steel sheets with a thickness of 0.23 mm. Subsequently, decarburization annealing and nitridation annealing (decarburization and nitridation annealing) was performed on the cold-rolled steel sheets in an atmosphere containing water vapor, hydrogen, nitrogen and ammonia to obtain decarburized nitrided steel sheets. In the decarburization and nitridation annealing, annealing was performed at temperatures T1 of 800° C. to 840° C. for 30 seconds, and then annealing was performed at 860° C. for 80 seconds.

Thereafter, an annealing separating agent containing MgO as a main component was applied, in a water slurry, to the surfaces of the decarburized nitrided steel sheets. Then, finish annealing was performed on them at 1200° C. for 20 hours to obtain finish-annealed steel sheets. Subsequently, treatments from the water washing to the formation of the insulating film were performed similarly to the first experiment to obtain samples of the grain-oriented electrical steel sheets.

Then, for each of the samples, the average value "average B8," the maximum value "B8max," the minimum value "B8min," and the difference "ΔB8" were obtained similarly to the first experiment. These results are listed in Table 4 together with the Cr contents and the Sn contents.

TABLE 4

| Sample No. | Cr Content (mass %) | Sn Content (mass %) | Average B8 (T) | B8 max (T) | B8 min (T) | ΔB8 (T) | NOTE |
|---|---|---|---|---|---|---|---|
| 51 | 0.005 | 0.006 | 1.909 | 1.917 | 1.890 | 0.027 | Embodiment |
| 52 | 0.070 | 0.005 | 1.916 | 1.927 | 1.904 | 0.023 | Embodiment |
| 53 | 0.140 | 0.007 | 1.915 | 1.926 | 1.902 | 0.024 | Embodiment |
| 54 | 0.212 | 0.004 | 1.908 | 1.918 | 1.889 | 0.029 | Embodiment |
| 55 | 0.005 | 0.044 | 1.919 | 1.929 | 1.906 | 0.023 | Embodiment |
| 56 | 0.004 | 0.085 | 1.918 | 1.927 | 1.904 | 0.023 | Embodiment |
| 57 | 0.005 | 0.253 | 1.907 | 1.916 | 1.888 | 0.028 | Embodiment |
| 58 | 0.072 | 0.122 | 1.913 | 1.923 | 1.899 | 0.024 | Embodiment |
| 59 | 0.160 | 0.038 | 1.913 | 1.923 | 1.899 | 0.024 | Embodiment |
| 60 | 0.180 | 0.161 | 1.911 | 1.922 | 1.897 | 0.025 | Embodiment |

As presented in Table 4, in any of the samples Nos. 51 to 60, the average value "average B8" was large to be 1.90T or more and the difference "ΔB8" was small to be 0.030T or less. In short, a high magnetic property was obtained and the variation in the magnetic property was small. Among them, in the samples No. 52, No. 53, No. 55, No. 56, and No. 58 to No. 60, each of which contains 0.010 mass % to 0.20 mass % of Cr and/or 0.010 mass % to 0.20 mass % of Sn, the average value "average B8" was particularly large to be 1.91T or more and the difference "ΔB8" was particularly small to be 0.025T or less.

INDUSTRIAL APPLICABILITY

The present invention is applicable, for example, in electrical steel sheet manufacturing industries and electrical steel sheet using industries.

The invention claimed is:

1. A method of manufacturing a grain-oriented electrical steel sheet, comprising:

hot rolling a steel containing Si: 2.5 mass % to 4.0 mass %, C: 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, and P: 0.01 mass % to 0.08 mass %, further containing at least one selected from the group consisting of Ti: 0.0020 mass % to 0.010 mass % and Cu: 0.010 mass % to 0.50 mass %, and a balance composed of Fe and inevitable impurities, to obtain a hot-rolled steel sheet;

annealing the hot-rolled steel sheet to obtain an annealed steel sheet;

cold rolling the annealed steel sheet to obtain a cold-rolled steel sheet;

decarburization annealing and nitridation annealing the cold-rolled steel sheet to obtain a decarburized nitrided steel sheet; and finish annealing the decarburized nitrided steel sheet, wherein the step of decarburization annealing and nitridation annealing comprises:

heating the cold-rolled steel sheet in a decarburizing and nitriding atmosphere;

performing first annealing at a first temperature within a range of 700° C. to 850° C. and with a holding time of at least 15 seconds to effectively diffuse the nitrogen entering a surface of the cold-rolled steel sheet into a central portion of the cold-rolled steel sheet; and then performing second annealing at a second temperature within a range of 860° C. to 950° C. and with a holding time of at least 15 seconds to adjust primary recrystallized grains to a sufficient size.

2. A method of manufacturing a grain-oriented electrical steel sheet, comprising:

hot rolling a steel containing Si: 2.5 mass % to 4.0 mass %, C: 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, and P: 0.01 mass % to 0.08 mass %, further containing at least one selected from the group consisting of Ti: 0.010 mass % or less and Cu: 0.50 mass % or less to satisfy at least one of Ti: 0.0020 mass % or more and Cu: 0.010 mass % or more, and a balance composed of Fe and inevitable impurities, to obtain a hot-rolled steel sheet;

annealing the hot-rolled steel sheet to obtain an annealed steel sheet;

cold rolling the annealed steel sheet to obtain a cold-rolled steel sheet;

decarburization annealing and nitridation annealing the cold-rolled steel sheet to obtain a decarburized nitrided steel sheet; and finish annealing the decarburized nitrided steel sheet, wherein the step of decarburization annealing and nitridation annealing comprises:

heating the cold-rolled steel sheet in a decarburizing and nitriding atmosphere;

performing first annealing at a first temperature within a range of 700° C. to 850° C. and with a holding time of at least 15 seconds to effectively diffuse the nitrogen entering a surface of the cold-rolled steel sheet into a central portion of the cold-rolled steel sheet; and then performing second annealing at a second temperature within a range of 860° C. to 950° C. and with a holding time of at least 15 seconds to adjust primary recrystallized grains to a sufficient size.

3. The method of manufacturing a grain-oriented electrical steel sheet according to claim 1 or 2, wherein the steel further contains at least one selected from the group consisting of Cr: 0.010 mass % to 0.20 mass %, Sn: 0.010 mass % to 0.20 mass %, Sb: 0.010 mass % to 0.20 mass %, Ni: 0.010 mass % to 0.20 mass %, Se: 0.005 mass % to 0.02 mass %, Bi: 0.005 mass % to 0.02 mass %, Pb: 0.005 mass % to 0.02 mass %, B: 0.005 mass % to 0.02 mass %, V: 0.005 mass % to 0.02 mass %, Mo: 0.005 mass % to 0.02 mass %, and As: 0.005 mass % to 0.02 mass %.

4. The method of manufacturing a grain-oriented electrical steel sheet according to claim 1 or 2, wherein the steel further contains at least one selected from a group consisting of Cr: 0.20 mass % or less, Sn: 0.20 mass % or less, Sb: 0.010 mass % to 0.20 mass %, Ni: 0.010 mass % to 0.20 mass %, Se: 0.005 mass % to 0.02 mass %, Bi: 0.005 mass % to 0.02 mass %, Pb: 0.005 mass % to 0.02 mass %, B: 0.005 mass % to 0.02 mass %, V: 0.005 mass % to 0.02 mass %, Mo: 0.005 mass % to 0.02 mass %, and As: 0.005 mass % to 0.02 mass %.

5. The method of manufacturing a grain-oriented electrical steel sheet according to claim 1, wherein the Ti content in the steel is 0.0020 mass % to 0.0080 mass %, the Cu content in the steel is 0.01 mass % to 0.10 mass %, and a relation of $20\times[Ti]+[Cu]\leq 0.18$ is satisfied where the Ti content (mass %) in the steel is expressed as [Ti] and the Cu content (mass %) is expressed as [Cu].

6. The method of manufacturing a grain-oriented electrical steel sheet according to claim 3, wherein the Ti content in the steel is 0.0020 mass % to 0.0080 mass %, the Cu content in the steel is 0.01 mass % to 0.10 mass %, and a relation of $20\times[Ti]+[Cu]\leq 0.18$ is satisfied where the Ti content (mass %) in the steel is expressed as [Ti] and the Cu content (mass %) is expressed as [Cu].

7. The method of manufacturing a grain-oriented electrical steel sheet according to claim 4, wherein the Ti content in the steel is 0.0020 mass % to 0.0080 mass %, the Cu content in the steel is 0.01 mass % to 0.10 mass %, and a relation of $20\times[Ti]+[Cu]\leq 0.18$ is satisfied where the Ti content (mass %) in the steel is expressed as [Ti] and the Cu content (mass %) is expressed as [Cu].

8. The method of manufacturing a grain-oriented electrical steel sheet according to claim 5, wherein a relation of $10\times[Ti]+[Cu]\leq 0.07$ is satisfied.

9. The method of manufacturing a grain-oriented electrical steel sheet according to claim 6, wherein a relation of $10\times[Ti]+[Cu]\leq 0.07$ is satisfied.

10. The method of manufacturing a grain-oriented electrical steel sheet according to claim 7, wherein a relation of $10\times[Ti]+[Cu]\leq 0.07$ is satisfied.

11. The method of manufacturing a grain-oriented electrical steel sheet according to claim 1, wherein the hot rolling the steel is performed after heating the steel to a temperature of 1250° C. or lower.

12. The method of manufacturing a grain-oriented electrical steel sheet according to claim 3, wherein the hot rolling the steel is performed after heating the steel to a temperature of 1250° C. or lower.

13. The method of manufacturing a grain-oriented electrical steel sheet according to claim 5, wherein the hot rolling the steel is performed after heating the steel to a temperature of 1250° C. or lower.

14. The method of manufacturing a grain-oriented electrical steel sheet according to claim 8, wherein the hot rolling the steel is performed after heating the steel to a temperature of 1250° C. or lower.

15. The method of manufacturing a grain-oriented electrical steel sheet according to claim 1 or 2, wherein the steel further contains at least one selected from the group consisting of Cr: 0.010 mass % to 0.20 mass % and Sn: 0.010 mass % to 0.20 mass %.

16. The method of manufacturing a grain-oriented electrical steel sheet according to claim 1 or 2, wherein the steel further contains at least one selected from the group consisting of Cr: 0.20 mass % or less and Sn: 0.20 mass % or less.

17. The method of manufacturing a grain-oriented electrical steel sheet according to claim 2, wherein the Ti content in the steel is 0.0020 mass % to 0.0080 mass %, the Cu content in the steel is 0.01 mass % to 0.10 mass %, and a relation of $20\times[Ti]+[Cu]\leq 0.18$ is satisfied where the Ti content (mass %) in the steel is expressed as [Ti] and the Cu content (mass %) is expressed as [Cu].

18. The method of manufacturing a grain-oriented electrical steel sheet according to claim 17, wherein a relation of $10\times[Ti]+[Cu]\leq 0.07$ is satisfied.

19. The method of manufacturing a grain-oriented electrical steel sheet according to claim 2, wherein the hot rolling the steel is performed after heating the steel to a temperature of 1250° C. or lower.

* * * * *